US009027783B2

(12) United States Patent
Houlton et al.

(10) Patent No.: US 9,027,783 B2
(45) Date of Patent: May 12, 2015

(54) CONTAINER AND METHOD OF MANUFACTURE THEREOF

(75) Inventors: Simon Houlton, Richmond Hill (CA); Gabriel Fekete, Mississauga (CA); Jason Collins, Richmond Hill (CA); Robert Barrett, Toronto (CA)

(73) Assignee: Polytainers Inc., Toronto (CA)

( * ) Notice: Subject to any disclaimer, the term of this patent is extended or adjusted under 35 U.S.C. 154(b) by 104 days.

(21) Appl. No.: 13/530,603

(22) Filed: Jun. 22, 2012

(65) Prior Publication Data

US 2012/0325828 A1 Dec. 27, 2012

Related U.S. Application Data

(60) Provisional application No. 61/499,766, filed on Jun. 22, 2011.

(51) Int. Cl.

| | |
|---|---|
| ***B65D 1/02*** | (2006.01) |
| ***B65D 1/26*** | (2006.01) |
| ***B65D 79/00*** | (2006.01) |

(52) U.S. Cl.

CPC ..... *B65D 1/26* (2013.01); *B65D 79/005* (2013.01)

(58) Field of Classification Search

USPC ..... 220/600, 89.1, 606, 608, 603, 609, 624, 220/628, 636

See application file for complete search history.

(56) References Cited

U.S. PATENT DOCUMENTS

| | | | | |
|---|---|---|---|---|
| 3,933,246 | A * | 1/1976 | Fulton | 206/520 |
| 3,979,009 | A * | 9/1976 | Walker | 220/609 |
| 4,206,845 | A * | 6/1980 | Christian | 206/508 |
| 5,593,063 | A * | 1/1997 | Claydon et al. | 220/608 |
| 6,223,931 | B1 * | 5/2001 | Strube et al. | 220/609 |
| 2011/0017700 | A1 * | 1/2011 | Patcheak et al. | 215/381 |

* cited by examiner

*Primary Examiner* — Andrew Perreault
(74) *Attorney, Agent, or Firm* — McMillan LLP

(57) ABSTRACT

A container including a sidewall having a top and bottom ends, a base attached to or proximate the bottom end defining a cavity bounded by the sidewall and by the base, and the base including at least a first portion having a first thickness and a second portion having a second thickness, such that the second thickness is less than the first thickness. A method for controlling deformation in a container including the steps of manufacturing the container as described above, filling the container with a substance, sealing the container at a top end thereof, inverting the container such that the container rests on its top end, allowing the substance to undergo a volume reduction resulting in a vacuum pressure within the container, wherein when subjected to the vacuum pressure, the base deforms at the second portion due to the second thickness being less than the first thickness.

4 Claims, 6 Drawing Sheets

CONTAINER AND METHOD OF MANUFACTURE THEREOF

RELATED APPLICATIONS

This application claims priority to U.S. Provisional Application No. 61/499,766 filed Jun. 22, 2011 the contents of which are herein expressly incorporated by reference.

FIELD OF INVENTION

The present invention relates to the field of containers and cups and more particularly a containing having controlled paneling characteristics.

BACKGROUND OF THE INVENTION

When a thermoplastic container, cup, or similar product is filled with a hot product, typically a liquid or a slurry, and then sealed, the contents reduces in volume as it cools. The hot gas in the cup cools, resulting in a vacuum inside the cup and deformation to the sidewalls, often referred to in the art as paneling. To understand this phenomenon more clearly, consider that a liquid container has part liquid product and part gas content therein. If, after sealing, the original mass of gas at the time the container is sealed contracts in volume, as would be the case with a decrease in temperature, it accordingly creates a vacuum. This vacuum in the container can collapse, or partially collapse the sidewalls, resulting in paneling.

Paneling is particularly a problem where the walls of the cup are thin, or otherwise not sufficiently rigid to prevent the collapse or deformation of the walls. This is increasingly the case as manufacturing targets require minimal use of material or where the aim is to reduce the overall weight of the container. Paneling results in a number of possible problems, including altering the appearance of the container to the point that consumers may not purchase or would otherwise return to a point of purchase a product in a container with collapsed sidewalls. Furthermore, where such containers are to be stacked on store shelves, for example, paneling may having a negative impact on the stackability of the containers.

As is known in the art, it is possible to mitigate some of the effects of paneling by designing containers with thicker walls, or having other strengthening elements within the container. However, these solutions are not always possible or can lead to increased material costs, container weight and other manufacturing and/or design inefficiencies. This is particularly the case as where manufacturing capabilities are able to produce thinner walled containers than has been possible in the past.

Accordingly, there is a need in the art for an improved container that mitigates one or more of the above identified problems in the prior art.

SUMMARY OF THE INVENTION

According to one embodiment of the invention, there is disclosed a container having a sidewall with a top end and a bottom end, a base attached to or proximate the bottom end defining a cavity bounded by the sidewall and by the base and the base including at least a first portion having a first thickness and a second portion having a second thickness. The second thickness is less than the first thickness such that when subjected to a vacuum pressure, the base deforms at the second portion.

According to an aspect of this embodiment, the sidewall is cylindrical and the base has a cross-section that is axially symmetric about a central axis of the cavity; the cross-section having a planar portion extending from a position proximate the sidewall to an edge of a concave portion.

According to another aspect of this embodiment, the base further includes an arcuate portion connecting the planar portion to the edge of the concave portion; the arcuate portion being convex with respect to the concave portion.

According to another aspect of this embodiment, the second portion having the second thickness is formed at an intersection of the planar portion and of the edge of the concave portion.

According to another aspect of this embodiment, the second portion having the second thickness is formed at an intersection of the planar portion and of the arcuate portion.

According to another aspect of this embodiment, an intersection of the arcuate portion and of the concave portion includes a portion having a thickness less than the first thickness.

According to another aspect of this embodiment, the second portion having the second thickness is formed along the arcuate portion.

According to another aspect of this embodiment, there is provided a skirt wall extending from an outer perimeter of the base such that the container rests on the skirt wall when placed on a surface.

According to another aspect of this embodiment, there is provided a lip portion at the top end of the sidewall.

According to a second embodiment of the invention, there is provided a method for controlling deformation in a container having a sidewall and a base defining a cavity therebetween, the method including manufacturing the container by providing a base for the container including at least a first portion having a first thickness and a second portion having a second thickness, wherein the second thickness is less than the first thickness, filling the container with a substance, sealing the container at a top end thereof, inverting the position of the container such that the container rests on its top end, and allowing the substance to undergo a volume reduction resulting in a vacuum pressure within the container. When subjected to the vacuum pressure the base deforms at the second portion due to the second thickness being less than the first thickness.

According to an aspect of this second embodiment, the sidewall is cylindrical and the base has a cross-section that is axially symmetric about a central axis of the cavity; the cross-section having a planar portion extending from a position proximate the sidewall to an edge of a concave portion.

According to another aspect of this second embodiment, the base further includes an arcuate portion connecting the planar portion to the edge of the concave portion; the arcuate portion being convex with respect to the concave portion.

According to another aspect of this second embodiment, the second portion having the second thickness is formed at an intersection of the planar portion and of the edge of the concave portion.

According to another aspect of this second embodiment, the second portion having the second thickness is formed at an intersection of the planar portion and of the arcuate portion.

According to another aspect of this second embodiment, the second portion having the second thickness is formed along the arcuate portion.

According to another aspect of this second embodiment, a skirt wall is provided extending from an outer perimeter of the base such that the container rests on the skirt wall when placed on a surface.

According to another embodiment of the invention, there is provided a container including a sidewall having a top end and a bottom end, a bottom surface attached to the bottom end and a base recessed within the bottom surface defining a cavity bounded by the sidewall, the bottom surface and by the base. The base including at least a first portion having a first thickness and a second portion having a second thickness, wherein the second thickness is less than the first thickness such that when subjected to vacuum pressure, the base deforms at the second portion.

It is therefore an object of the invention to address one or more of the deficiencies in the prior art. Other and further advantages and features of the invention will be apparent to those skilled in the art from the following detailed description thereof, taken in conjunction with the accompanying drawings, a brief description of which follows below.

BRIEF DESCRIPTION OF THE DRAWINGS

The invention will now be described in more detail, by way of example only, with reference to the accompanying drawings, in which like numbers refer to like elements, wherein.

DETAILED DESCRIPTION OF THE INVENTION

The invention provides for the possibility of a lightweight container that, rather than attempting to altogether suppress paneling, controls the location of deformation resulting from a paneling effect. In this manner, the prior art solutions of providing thicker walled containers or including additional strengthening elements becomes altogether unnecessary, and containers with thinner walls and more efficient liquid storage becomes possible. While the invention is described with respect to liquid storage, it will be appreciated by a person skilled in the art that other substances may also be stored within the container as herein described. In an illustrative application of a hot fill application, that is, when a liquid is filled into the container at a temperature elevated from room temperature, or alternatively, elevated from the storage temperature, and subsequently allowed to cool to room temperature (or to the storage temperature), it is the weakest walls that undergo the effects of paneling. This is typically the sidewalls of the container that are rounded and have the largest surface area upon which the effects of the onset of vacuum within the container can act.

Embodiments of the invention generally provide for an improved container, and in particular, a base of a container having one, preferably two and optionally more flex lines formed by regions of thinning material located at predetermined locations on the base of the container. This arrangement permits for sections of the base of the container to be purposefully designed to be the weakest points within the container, and to therefore be the first to deform when a vacuum pressure is applied within the container. As an example, when in use, the container is preferably filled with a substance, sealed and cooled upside down. This results in the air in the container being at the bottom (that is the base side) of the container. When this air cools and contracts, the vacuum created will cause the weakest areas to deform. The container design based on the teachings of the invention will thus result in most, if not all of the deformation occurring on the base of the container at locations proximate the flex lines. The result of this controlled deformation is that the structural integrity with respect to the outer walls of the container and appearance of the container are maintained in acceptable form.

Figure 1:
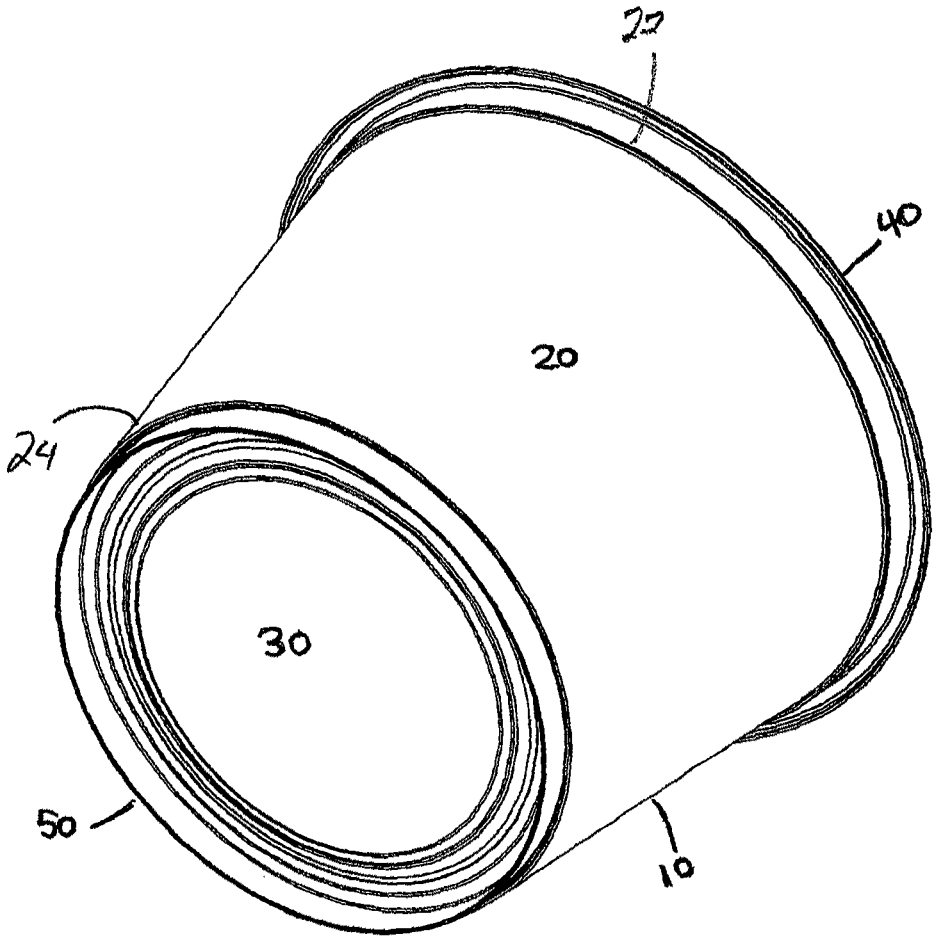
FIG. 1 is a perspective view of a container according to one embodiment of the invention.
Figure 2:
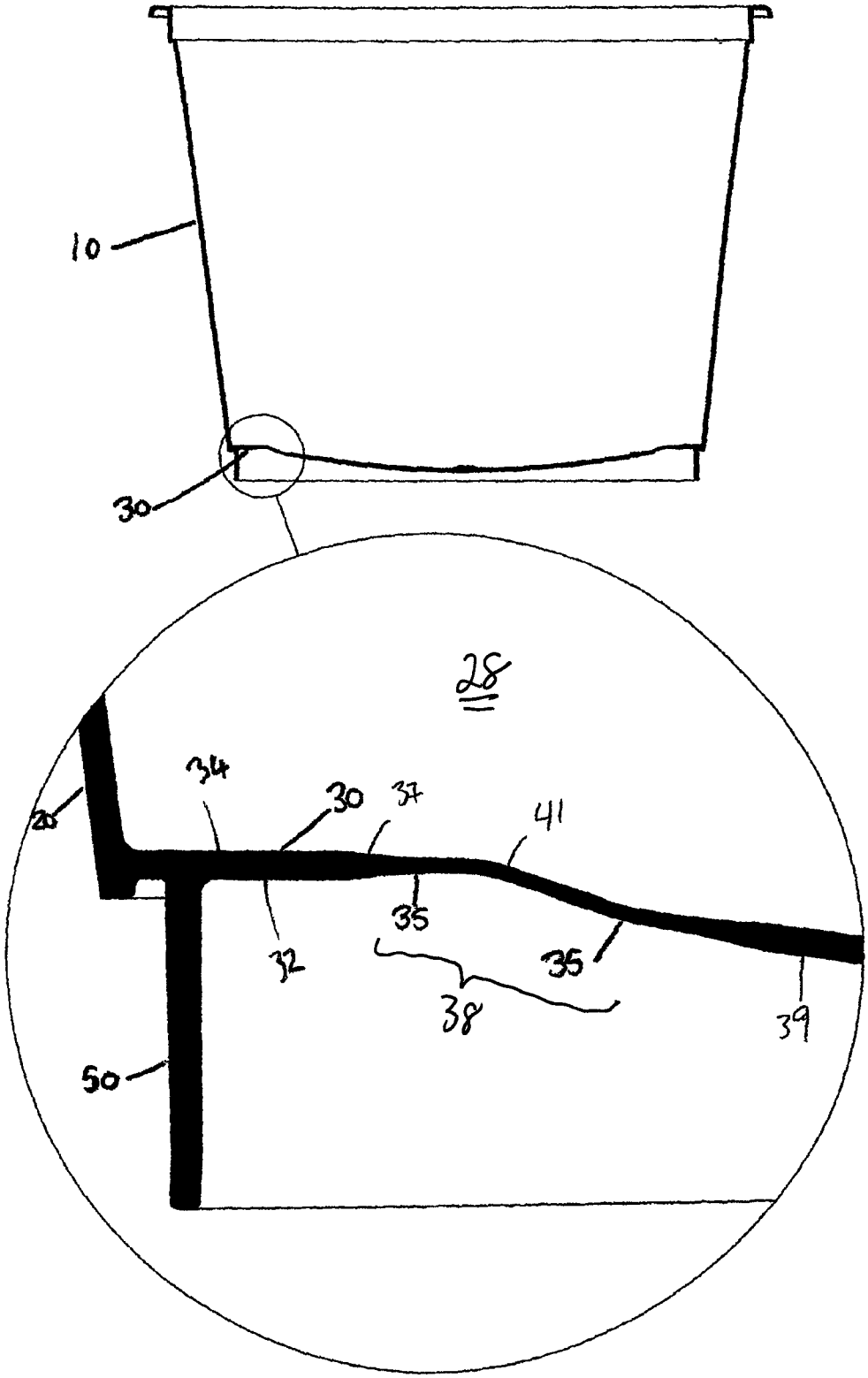
FIG. 2 is a sectional view and detail thereof of the container of FIG. 1 prior to being sealed.
Figure 3:
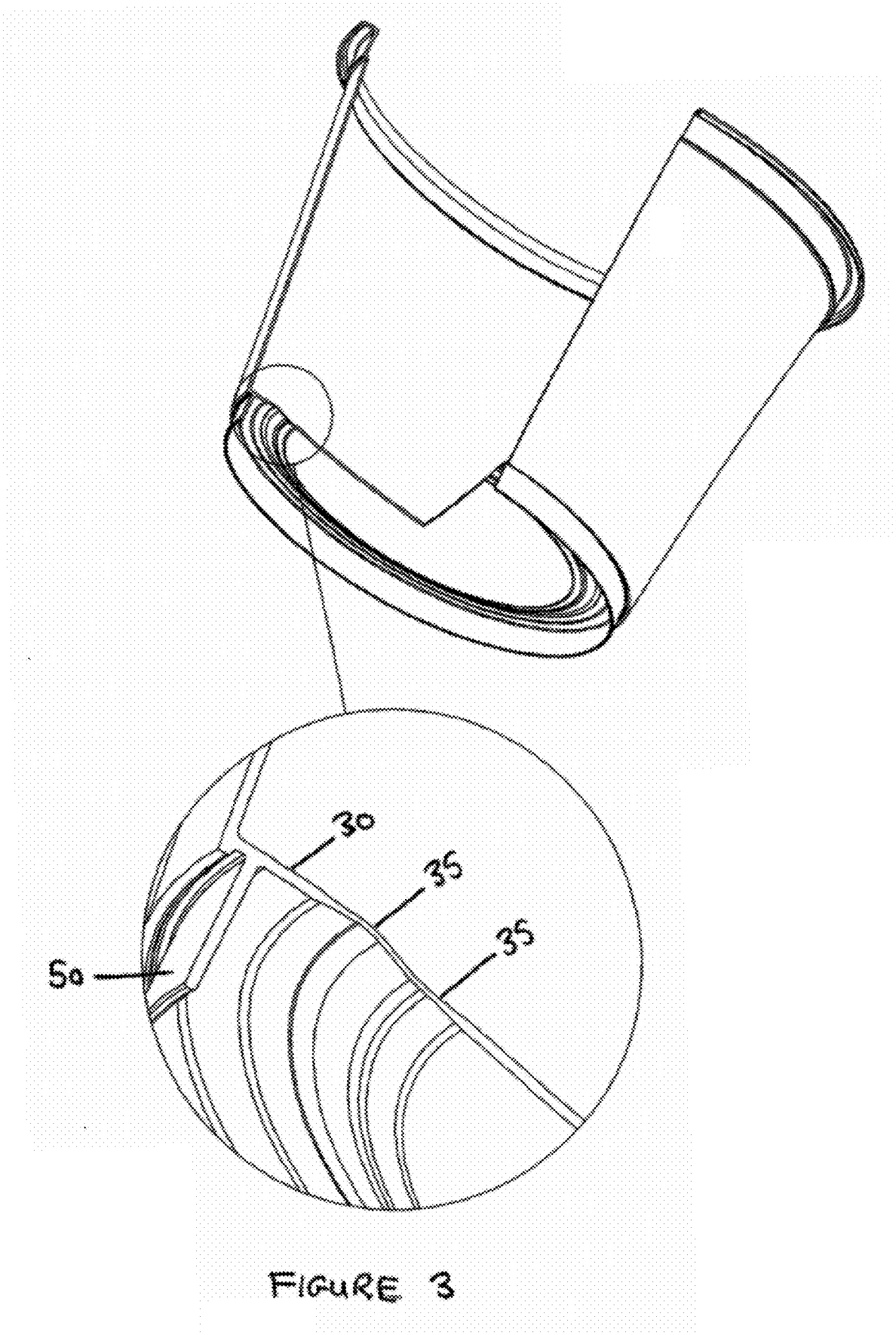
FIG. 3 is a perspective view and detail thereof of the container of FIG. 1 prior to being sealed.
Figure 4:
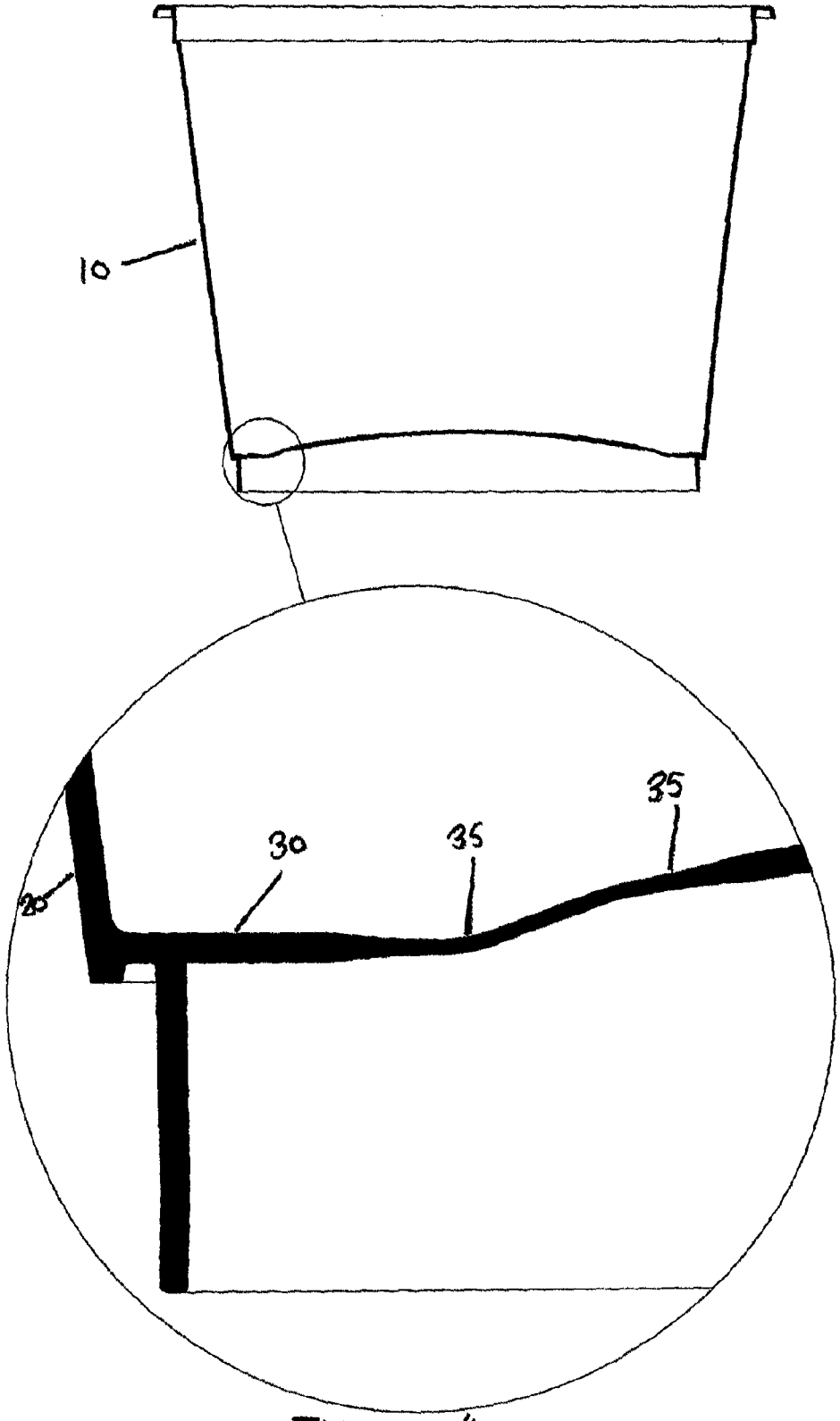
FIG. 4 is a sectional view and detail thereof of the container of FIG. 1 after undergoing controlled paneling according to the invention.

Referring now to FIGS. 1 and 2, there is shown one embodiment of the container 10 according to the invention. The container 10 would typically be used for storing a liquid that is normally hot filled, and subsequently cooled to room, or storage, temperature. The container 10 generally includes a sidewall 20 having a top end 22 and a bottom end 24. Optionally, the top end 22 also includes a lip portion for facilitating attachment of a cover, holding the container or facilitating in stacking multiple containers. A base 30 is attached to or proximate the bottom end 24 of the sidewall 20. Accordingly, the sidewall 20 and base 30 define a cavity 28 of the container for holding the substance being stored, and in particular a liquid. A sealing cap (not shown) encloses the cavity when a liquid is stored therein. The sidewall 30 is preferably cylindrical, or in particular a tapered cylindrical shape. Furthermore, the sidewall 30 is also preferably formed as a unitary element, as would be the case where the container is injection molded as is preferred.

The base 30 is shown in more detail in FIG. 2, and is illustrated as having at least a first portion 32 having a first thickness and a second portion 35 having a second thickness. The second thickness is less than the first thickness, such that the intersections of the first portion 32 and the second portion 38 form the flex lines that typically encircle the base. It is along these flex lines that the base 30 is designed to deform when the cavity in the container 30 is subjected to a pressure, and more specifically a vacuum pressure.

The base 30 is shown in more detail in FIG. 2, and is illustrated as having at least a first portion 32 having a first thickness and a second portion 35 having a second thickness. The second thickness is less than the first thickness, such that the intersections of the first portion 32 and the second portion 35 form the flex lines that typically encircle the base. It is along these flex lines that the base 30 is designed to deform when the cavity in the container 30 is subjected to a pressure, and more specifically a vacuum pressure.

The base 30 of the container 20 is axially symmetric about a central axis 26 of the container 20, and in particular of the cavity within the container 20. Being axially symmetric, a convenient way to describe the shape of the base 30 is with respect to its cross-section, as is shown in the detail view of FIG. 2. Generally, the cross-section of the base 30 includes a generally planar portion 34 extending from a position proximate the sidewall 20 to an edge 37 of a concave portion 39 of the base 30. The concave portion 39 is concave with respect to the cavity of the container 20. Optionally, an arcuate portion 41 may be provided to connect the planar portion 34 to the edge of the concave portion 39. The arcuate portion 41 is preferably convex with respect to the concave portion 39 to thereby facilitate and provide for a smooth deformation in the base 30 of the container 10. That is, the arcuate portion is 41 has a thickness that is less than the thickness of each of the planar portion 34 and of the convex portion 39, such that the intersection of the arcuate portion 41 and the planar portion 34, and further the intersection of the arcuate portion 41 and the convex portion 39 form the flex lines around which the base of the container is designed to deform when placed under a vacuum pressure, as was described above.

A skirt wall 50 is also preferably provided extending from an outer perimeter of the base 30 such that the container 10 rests on the skirt wall 50 when the container 10 is placed on a surface. The skirt wall 50 is provided to hide the base surface 30 from regular view, such that in situations where drastic deformation is seen in the base surface, the container 50 maintains an overall acceptable appearance to a user or customer, and furthermore, maintains the ability to be stacked on other containers since the outer surfaces of the container 10 that would come into contact with, or otherwise impact the manner in which the container 10 balances, are all held intact.

As will be appreciated, the cross-section of the base 30 as described above results in at least one, and typically a plurality of flex lines around which the base 30 will yield when a vacuum pressure is applied. Where the vacuum is strong enough, the convex base 30 will completely invert around one of the flex lines and become concave within the cavity of the container 10.

The container 10 is preferably formed from an injection moulded thermoplastic material and is produced as a thin-walled container to minimize weight and optimize tolerances available during production. These construction details of thermoplastic containers are generally known in the art and are not further discussed herein.

In use, the hot liquid will be filled into the container 10 as it appears in FIG. 2. The liquid is filled to a level that allows for a predetermined amount of air space to remain in the container. Next, the container is sealed with a lid being applied. Alternatively, sealing could be by way of a plastic film covering a top opening of the container 10. According to the invention, after sealing, the container 10 is turned upside-down such that it is resting on the lid, or alternatively on the top lip 40 as it is cooling. Accordingly, the predetermined amount of air space will be between a top surface of the liquid and the base surface 30 as the liquid cools. During this time, a vacuum will be created, or otherwise increased in the space between the liquid and the container 10. The vacuum is created and a paneling effect takes place in the container 10, the areas of the container that are weaker than the rest will deform or panel first. Due to the provision of thinning regions 35 on the base surface 30, paneling or deformation will occur at the flex lines at thinner regions 35, rather than on the sidewall 20 of the container.

Figure 5:
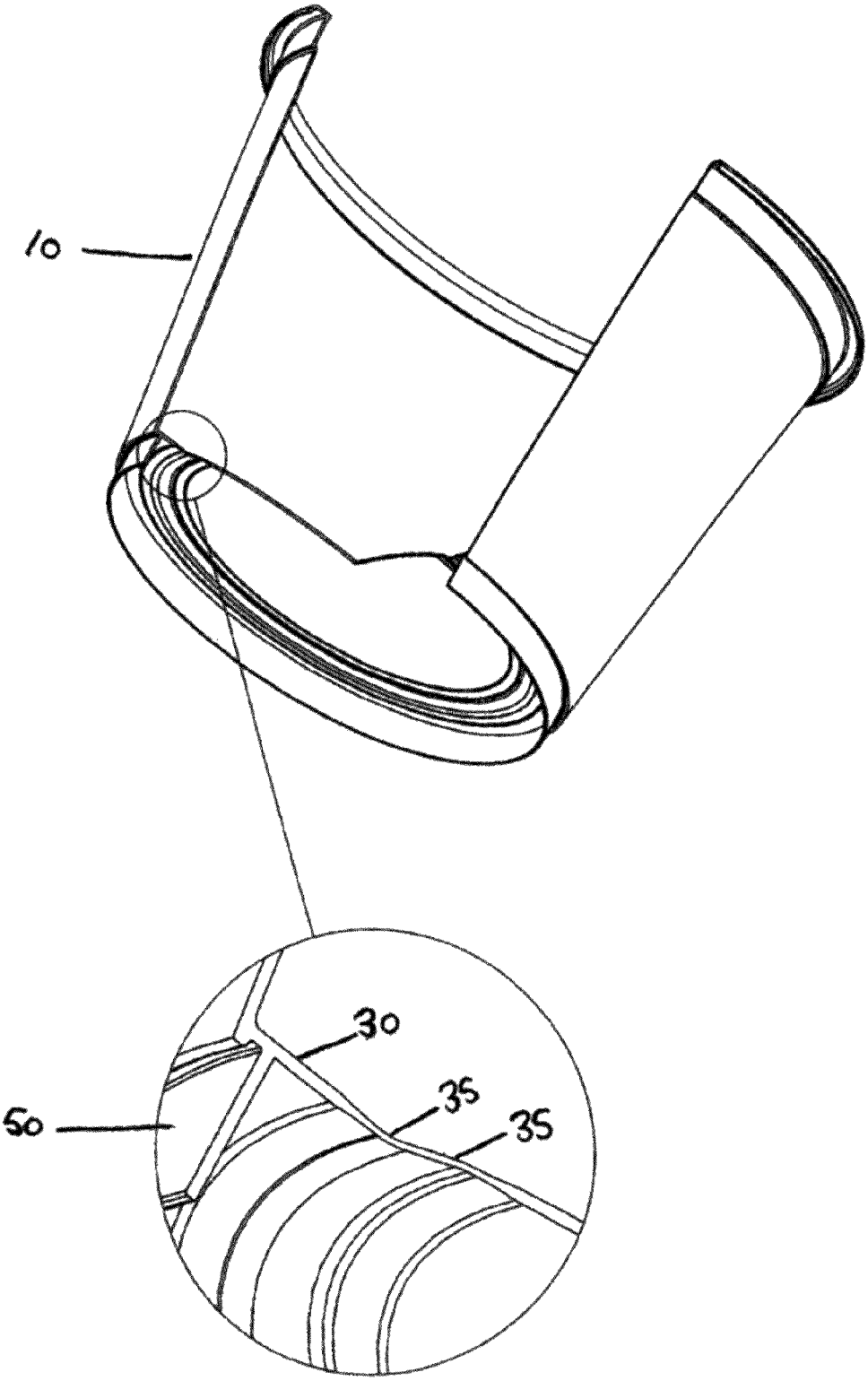
FIG. 5 is a perspective view and detail thereof of the container of FIG. 1 after undergoing controlled paneling according to the invention.
Figure 6:
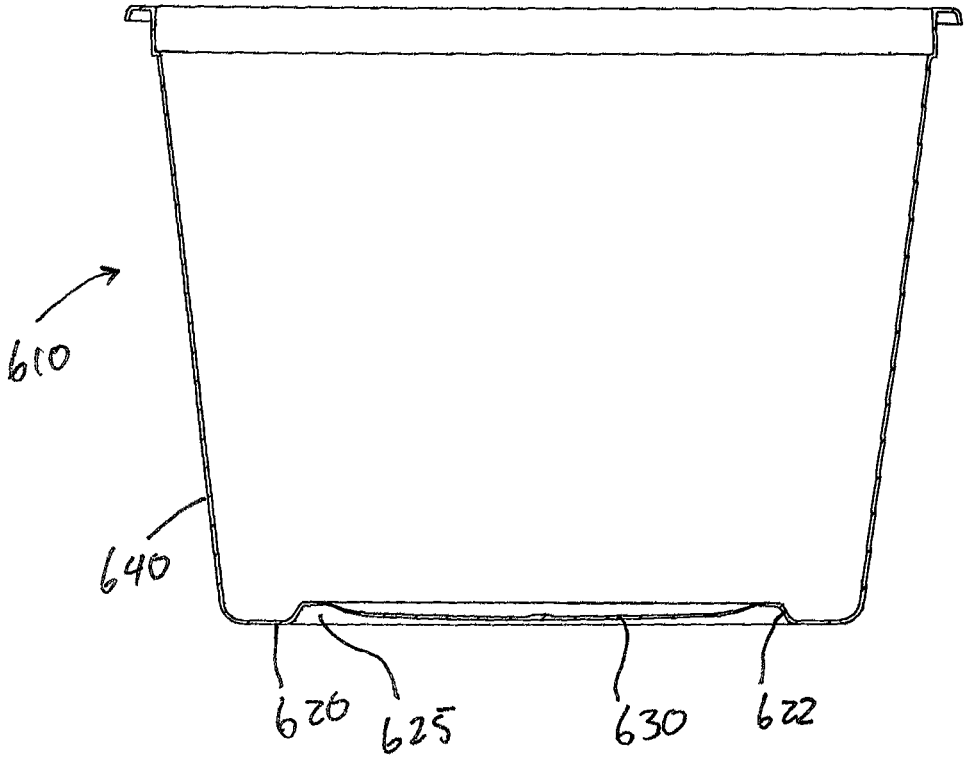
FIG. 6 is a front view of a container according to another embodiment of the invention.

Referring now to FIG. 5, there is shown the container 10 with the vacuum having caused deformation and paneling on the base surface 30. FIG. 6 shows a perspective view of the relevant portions along with a detail of the perspective as well. As shown, deformation has occurred primarily along the thinning regions 35 resulting in the bottom surface 30 now forming a generally convex shape as it has been drawn inwards by the vacuum pressure within the container.

Skirt 50 provides the additional benefit of hiding the base surface 30 when it has been deformed and otherwise, also provides for a consistent edge on which the container can be stored or stacked, that is not subject to the vacuum within the container. Thus, even though the base surface 30 may be deformed, the skirt 50 is unaltered and maintains its rigidity for providing a surface on which the container may be stored or stacked.

Referring now to FIG. 6, there is shown another embodiment of the invention in which base 630 is formed in a recessed portion of a bottom surface 620 of the container 610. The base 630 may include all the features, and in particular, the regions of different thicknesses and arcuate section of the base 30 described above with respect to the first embodiment, but rather than being connected directly to a sidewall 640 of the container 610, the base 630 is provided in the recessed portion 625 of the bottom surface 620. Accordingly, in this embodiment, the container 610 rests on bottom surface 620 that extends directly from sidewall 640 as illustrated. Bottom surface 620 includes bottom surface wall 622 that extends towards the inside of the container 610 to form the recessed portion to which base 630 is attached. Reference is made to the description of base 30 as described with respect to FIGS. 1 to 5 for a full description of the features and operation of base 630.

According to another embodiment of the invention, there is provided a method for controlling deformation in a container, and in particular a method for controlling paneling in a container holding a substance that undergoes a volumetric change within the container resulting in the onset of vacuum pressure on the inner walls of the container. The container generally includes a sidewall and a base as herein described. The method includes the steps of manufacturing the container as herein described, and in particular manufacturing the container to have a base having at least a first portion having a first thickness and a second portion having a second thickness, wherein the second thickness is less than the first thickness. The invention is not limited to particular manufacturing methods, but the advantages provided by the invention are most applicable to the container when injection moulded. Methods of injection moulding containers in general are well know, and are therefore not described herein in further detail.

The method further includes the steps of, as the container is in use, filling the container with a substance and sealing the container. The substance is preferably a liquid that is hot filled and following sealing, the container is inverted such that the container rests on its top end. In particular, the base of the container is positioned higher than a top end of the container such that any air in the container after filling is located between the liquid within the container and the base of the container. Next, the liquid undergoes a volume reduction as it is cooled. In combination with the air in the container undergoing a temperature change as well, the reduction in temperature results in a vacuum pressure within the container. When subjected to this vacuum pressure, the base deforms along flex lines resulting at the second portion due to the thickness of the second portion being less than the thickness of the first portion.

It will be understood by those skilled in the art that the invention may be applied to a variety of types of containers, cups, other storage vessels, where such targeted deformation to mitigate the effects of paneling are desired. While the invention has been described with respect to a thermoplastic material container, other materials may also be used.

We claim:

1. A container comprising a sidewall having a top end and a bottom end;

a base attached to or proximate said bottom end defining a cavity bounded by said sidewall and by said base;

said base including at least a first portion having a first thickness and a second portion having a second thickness, wherein said second thickness is less than said first thickness such that when subjected to vacuum pressure, said base deforms at said second portion;

wherein said sidewall is cylindrical and said base have a cross-section that is axially symmetric; said cross-section having a planar portion extending from a position proximate said sidewall to an edge of a concave portion;

an arcuate portion connecting said planar portion to said edge of said concave portion; said arcuate portion being convex with respect to said concave portion;

wherein an intersection of said arcuate portion and of said concave portion includes a portion having a thickness less than said first thickness.

2. The container according to claim 1, wherein said second portion having said second thickness is formed along said arcuate portion.

3. The container according to claim 1, further comprising a skirt wall extending from an outer perimeter of said base such that the container rests on said skirt wall when placed on a surface.

4. The container according to claim 1, further comprising a lip portion at said top end of said sidewall.

* * * * *